US011289289B2

(12) United States Patent
Takeshita

(10) Patent No.: US 11,289,289 B2
(45) Date of Patent: Mar. 29, 2022

(54) EMERGENCY STOP SWITCH

(71) Applicant: NKK SWITCHES CO., LTD., Kawasaki (JP)

(72) Inventor: Junya Takeshita, Kawasaki (JP)

(73) Assignee: NKK SWITCHES CO., LTD., Kawasaki (JP)

( * ) Notice: Subject to any disclaimer, the term of this patent is extended or adjusted under 35 U.S.C. 154(b) by 0 days.

(21) Appl. No.: 16/651,696

(22) PCT Filed: Sep. 25, 2018

(86) PCT No.: PCT/JP2018/035448
§ 371 (c)(1),
(2) Date: Mar. 27, 2020

(87) PCT Pub. No.: WO2019/065627
PCT Pub. Date: Apr. 4, 2019

(65) Prior Publication Data

US 2020/0234895 A1 Jul. 23, 2020

(30) Foreign Application Priority Data

Sep. 29, 2017 (JP) ..... JP2017-189533

(51) Int. Cl.
*H01H 25/00* (2006.01)
*H01H 3/02* (2006.01)
*H01H 13/14* (2006.01)

(52) U.S. Cl.
CPC ..... *H01H 25/008* (2013.01); *H01H 3/022* (2013.01); *H01H 13/14* (2013.01); *H01H 2221/01* (2013.01); *H01H 2235/01* (2013.01)

(58) Field of Classification Search
CPC ..... H01H 25/008; H01H 3/022; H01H 13/14; H01H 2221/01; H01H 2235/01;
(Continued)

(56) References Cited

U.S. PATENT DOCUMENTS 8,115,122 B2 * 2/2012 Machida ..... H01H 3/022 200/43.07
9,349,550 B2 * 5/2016 Benni ..... H01H 13/62
(Continued)

FOREIGN PATENT DOCUMENTS

DE 20305387 U1 7/2003
EP 1261980 A1 12/2002
(Continued)

OTHER PUBLICATIONS

International Search Report corresponding to PCT/JP2018/035448; dated Nov. 27, 2018.

*Primary Examiner* — Lheiren Mae A Caroc
(74) *Attorney, Agent, or Firm* — Cantor Colburn LLP

(57) ABSTRACT

The problem to be addressed is to provide a highly safe and compact switch that is adapted to improvements in portability, weight reduction and size reduction of machines, or the like. An operating part has a button covering the upper part of a cylindrical housing that receives a downward pushing operation and a rotational operation. A contact unit part has contacts which open by being coupled to the downward pushing operation of the button. A twisting coil spring is disposed on the interior of the button, one end being joined to the housing, and the other end being joined to the button. A latch part disposed to the interior of the twisting coil spring, has a plunger coil spring that expands and contracts in a direction perpendicular to the direction of the downward pushing operation, and when a downward pushing operation is performed on the button, causes a sliding rod to slide along an inner wall of the housing while being displaced in the direction of the downward pushing operation.

3 Claims, 5 Drawing Sheets

(58) Field of Classification Search
CPC ..... H01H 13/62; H01H 13/10; H01H 9/20; H01H 9/24; H01H 9/28; H01H 3/20; H01H 2003/0246; H01H 3/38; H01H 3/163; H01H 13/506; H01H 9/22; H01H 1/26; H01H 2221/036; H01H 25/00; H01H 3/02
USPC ..... 200/4
See application file for complete search history.

(56) References Cited

U.S. PATENT DOCUMENTS

| | | | | |
|---|---|---|---|---|
| 9,653,235 | B2 * | 5/2017 | Shimoyama | H01H 13/62 |
| 10,068,729 | B2 * | 9/2018 | Shimoyama | H01H 13/62 |
| 10,566,149 | B2 * | 2/2020 | Wu | H01H 3/20 |
| 2010/0243418 | A1 | 9/2010 | Machida et al. | |
| 2015/0340178 | A1 | 11/2015 | Shimoyama et al. | |

FOREIGN PATENT DOCUMENTS

| | | | |
|---|---|---|---|
| JP | 2006040606 | A | 2/2006 |
| JP | 3909082 | B | 4/2007 |
| JP | 2008311097 | A | 12/2008 |
| JP | 2010232157 | A | 10/2010 |
| WO | 2014119140 | A1 | 8/2014 |

* cited by examiner

EMERGENCY STOP SWITCH

CROSS REFERENCE TO RELATED APPLICATIONS

This is the U.S. national stage of application No. PCT/JP2018/035448, filed on Sep. 25, 2018. Priority under 35 U.S.C. § 119(a) and 35 U.S.C. § 365(b) is claimed from Japanese Application No. 2017-189533, filed Sep. 29, 2017, the disclosure of which is also incorporated herein by reference.

TECHNICAL FIELD

The present invention relates to a switch.

BACKGROUND ART

A control box for the operation of machinery or the like is generally provided with an emergency stop switch for preventing the occurrence of accidents caused by failures. When the pushing operation is performed on this emergency stop switch, a power supply is disconnected and running of the machinery or the like is stopped immediately. With a view to assuring safety, various regulations about the shape of a button part, prevention of return after the pushing operation and the like apply to emergency stop switches. Therefore, various constraints apply to the shape, structure and the like of emergency stop switches. Accordingly, the shape of the button portion of an emergency stop switch is commonly a mushroom shape, a cone shape or the like, and the structure of an emergency stop switch is commonly a structure that is prevented from easily returning to an electrification state by a latch function that employs a snap spring or the like. For example, Patent Document 1 proposes a push-button switch that, by the application of an urging force from separating urging means, may prevent a contact of an electrification member from returning to a touching state or a proximity state.

Patent Document 1: Japanese Patent No. 3909082

DISCLOSURE OF THE INVENTION

Problems to be Solved by the Invention

However, when steps are taken to make the structure of an emergency stop switch compatible with these various constraints, the emergency stop switch becomes larger, which means that the emergency stop switch may not be compatible with advances in size reduction, weight reduction and portability of machinery and the like. For example, an emergency stop switch provided at a teaching pendant that is for teaching tasks to a robot must be compact in order to be suitable for carrying. When an emergency stop switch is mounted at a control box, it is required that, of parts structuring the emergency stop switch, the dimensions of parts disposed inside the control box should be reduced and that space inside the control box should be used efficiently.

The present invention has been devised in consideration of this situation; an object of the present invention is to provide a switch that is highly safe and compact and that is compatible with advances in size reduction, weight reduction and portability of machinery and the like.

Means for Solving the Problems

In order to achieve the object described above, a switch relating to the present invention includes: a cylindrical housing; an operating part disposed at an upper region of the housing and including a button that accepts a pushing operation and a turning operation; a contact unit part including a contact that separates in conjunction with the pushing operation of the button; a twisting coil spring disposed inside the button, one end of the twisting coil spring being joined to the housing and another end of the twisting coil spring being joined to the button; and a latch part that includes a plunger and is disposed inside the twisting coil spring, the plunger compressing in a direction perpendicular to the direction of the pushing operation and, when the pushing operation is performed on the button, the latch part displacing in a direction of the pushing operation while an end portion of the plunger slides along an inner wall of the housing.

According to the present invention, because the latch part is disposed inside the twisting coil spring, space inside the switch may be used efficiently and the switch itself may be made compact. Therefore, a compact switch may be provided that is compatible with advances in size reduction, weight reduction and portability of machinery and the like.

In the switch according to the present invention, the plunger may be compressed in the direction perpendicular to the direction of the pushing operation. According to the present invention, the latch part may be compactly disposed inside the twisting coil spring.

In the switch according to the present invention, it is preferable if a shape of a portion of the inner wall of the housing includes a protrusion portion and, when the pushing operation is performed on the button, the protrusion portion urges the contact in a touching direction before the plunger passes the peak portion of the protrusion portion, and urges the contact in a separating direction after the plunger passes the peak portion of the protrusion portion.

According to the present invention, the latch function acts. Consequently, before the plunger passes the peak portion of the protrusion portion, the latch function urges the contact in the contacting direction, and after the plunger passes the peak portion of the protrusion portion, the latch function urges the contact in the separating direction. Therefore, a highly safe switch may be provided that may prevent misoperation by an operator of the machinery or the like and prevent occurrences of chattering due to contact bounce and the like. Moreover, according to the present invention, because the urging directions before and after the plunger passes the peak portion of the protrusion portion are opposite directions, an operator can recognize a contact switching timing from a clear difference in operational feel.

Effects of the Invention

According to the present invention, a highly safe and compact switch may be provided that is adapted to advances in size reduction, weight reduction and improved portability of machinery and the like.

PREFERRED MODE FOR CARRYING OUT THE INVENTION

Figure 1A:
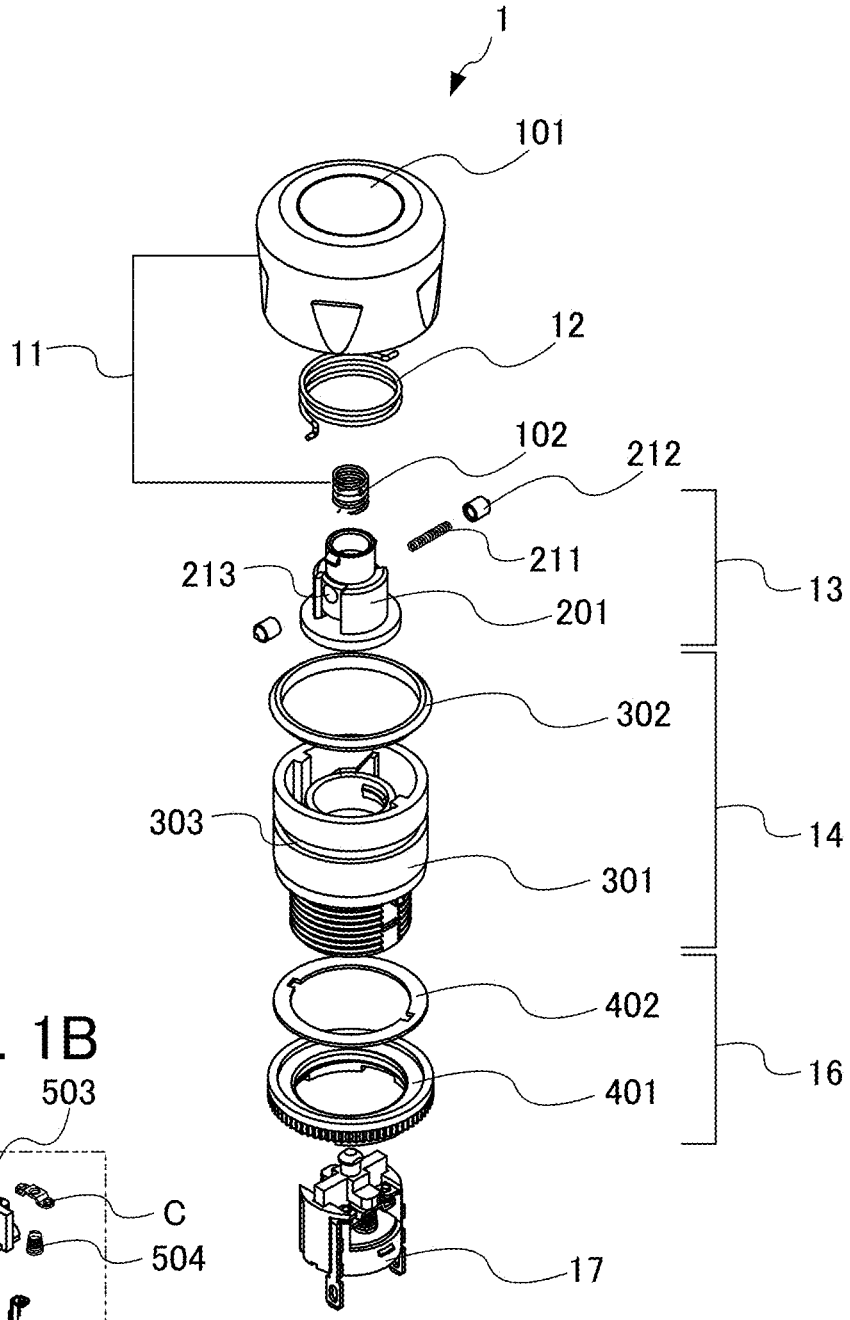
FIG. 1A is an exploded perspective diagram of an emergency stop switch according to an embodiment of the switch of the present invention.

An emergency stop switch 1 according to an embodiment of the switch of the present invention is described with reference to the drawings. Note, however, that the present invention is not limited to the embodiment described below.

—Basic Structure—

The emergency stop switch 1 is a switch to be used for putting machinery or the like that is in an electrified state into a disconnected state and causing an emergency stop. As shown in FIG. 1A to FIG. 3B, the emergency stop switch 1 is constituted with an operating part 11, a twisting coil spring 12, a latch part 13, a housing part 14, a contact unit part 15 and a fixed part 16.

The structural elements of the emergency stop switch 1 are described in detail below.

Operating Part

The operating part 11 is structured with a button 101 and a button coil spring 102.

As illustrated in FIG. 1A to FIG. 3B, the button 101 is a cylindrical button disposed in an uppermost region of the emergency stop switch 1. When a pushing operation is performed on the button 101, a contact C of the contact unit part 15, which is described below, and a fixed terminal 502 separate in conjunction with the pushing operation. When the contact C separates from the fixed terminal 502, the machinery or the like in the electrified state is put into the disconnected state. The shape of the button 101 is not particularly limited but is preferably a shape that an operator, who operates the emergency stop switch 1 by pushing at a time of emergency, can easily recognize as being a switch for causing an emergency stop of the machinery or the like and that the operator can easily push with their palm.

The button coil spring 102 is a coil spring that is disposed between the button 101 and a plunger main body 201. The button coil spring 102 absorbs a little of a force that is applied when the button 101 is pushed. Thus, the button 101 may be provided with a little allowance. As a result, disconnection of the machinery or the like due to misoperation of the button 101 may be avoided.

Twisting Coil Spring

As illustrated in FIGS. 2A and 2B and FIGS. 3A and 3B, the twisting coil spring 12 is a coil spring that is disposed inside the button 101. One end of the twisting coil spring 12 is joined to a housing 301 of the housing part 14, which is described below, and the other end of the twisting coil spring 12 is joined to the button 101 of the operating part 11.

After a pushing operation has been performed on the button 101, when a turning operation is performed on the button 101, the twisting coil spring 12, by elastic deformation, restores the button 101 in a pushed state to the state thereof prior to the pushing operation. When the button 101 is restored to the state prior to the pushing operation by this turning operation, the contact C of the contact unit part 15 that is in the separated state is again restored to a state of contact with the fixed terminal 502 (the state thereof prior to the pushing operation). The latch part 13 is disposed at the inner side of the twisting coil spring 12, utilizing space inside the twisting coil spring 12.

Latch Part

Figure 1B:
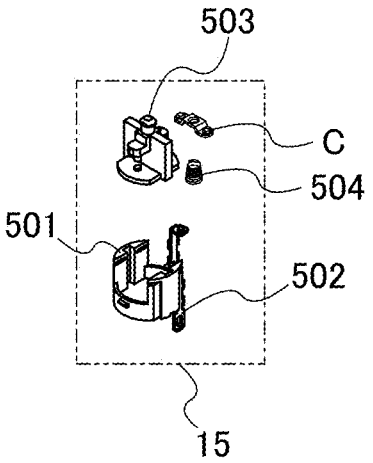
FIG. 1B is an enlarged view of a portion of the emergency stop switch of FIG. 1A.
Figure 2A:
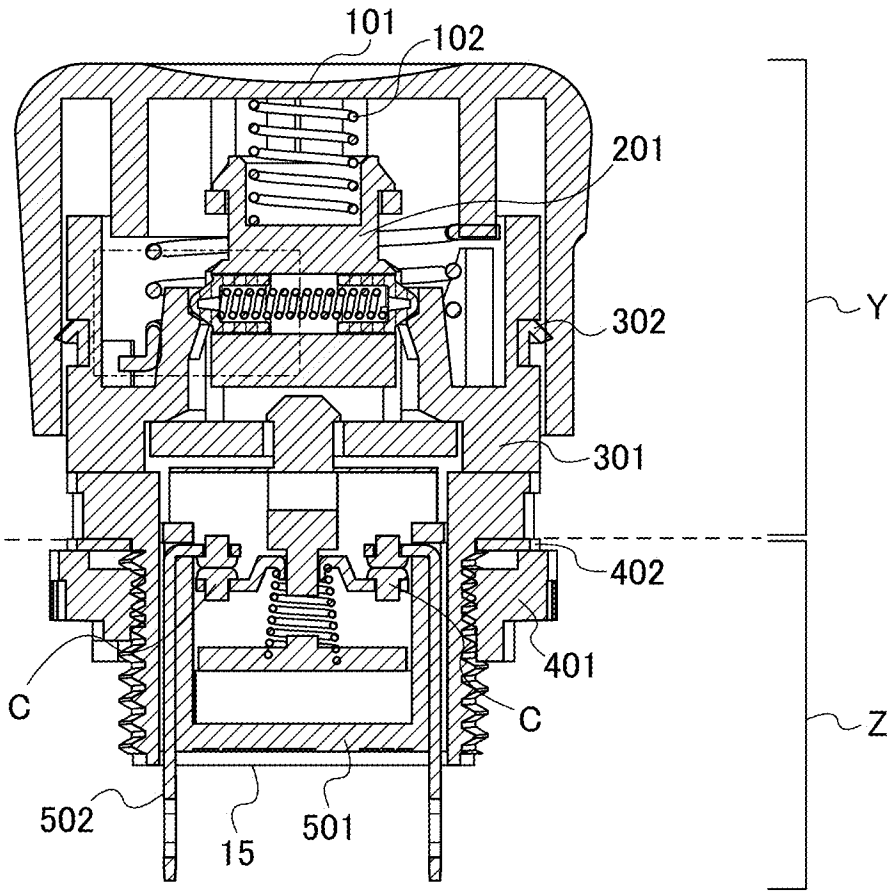
FIG. 2A is a sectional diagram illustrating a state before the emergency stop switch of FIG. 1A is pushed.
Figure 2B:
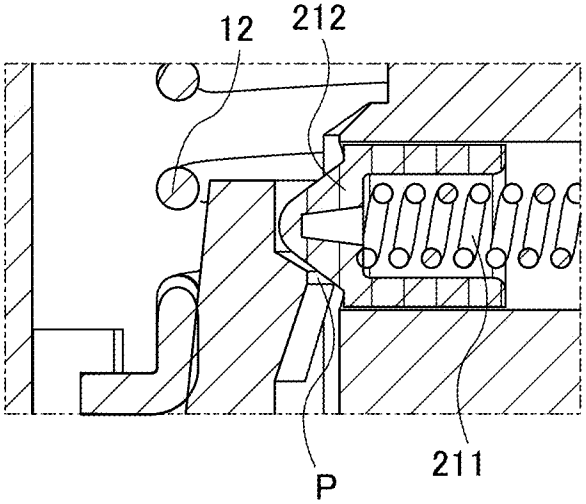
FIG. 2B is an enlarged view of a portion of the emergency stop switch of FIG. 2A.
Figure 3A:
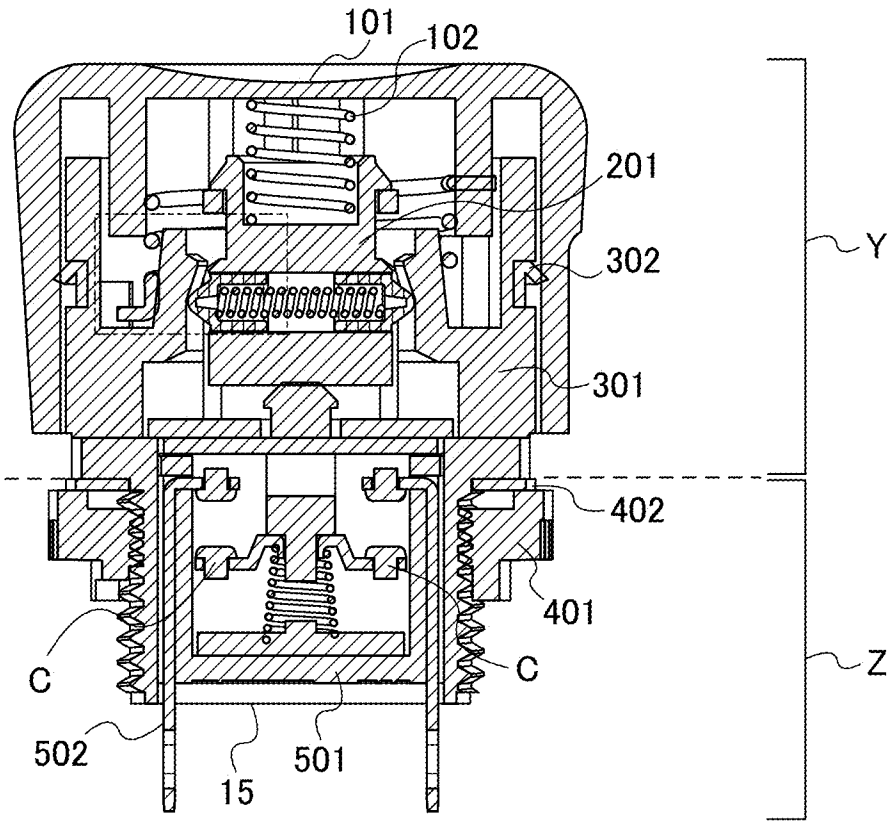
FIG. 3A is a sectional diagram illustrating a state after the emergency stop switch of FIG. 1A is pushed.
Figure 3B:
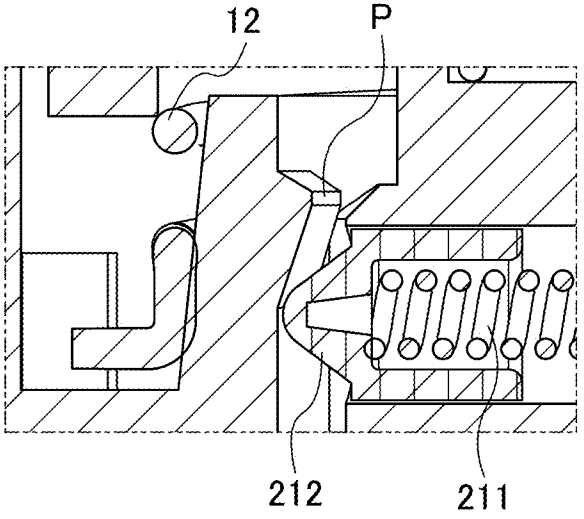
FIG. 3B is an enlarged view of a portion of the emergency stop switch of FIG. 3A.

As illustrated in FIGS. 1A and 1B, the latch part 13 includes the plunger main body 201, a plunger coil spring 211 and a sliding rod 212. As illustrated in FIGS. 2A and 2B and FIGS. 3A and 3B, the latch part 13 is disposed inside the twisting coil spring 12 and is disposed so as to close off an aperture portion in an upper region of the housing 301, which is described below.

A penetrating hole 213 is provided in a central region of the plunger main body 201. The plunger coil spring 211 is disposed inside this penetrating hole 213. The sliding rod 212 is joined to both of end portions of the plunger coil spring 211.

When the pushing operation is performed on the button 101, the latch part 13 displaces in the direction of the pushing operation. When the latch part 13 displaces in the direction of the pushing operation, the plunger main body 201 is compressed in a direction perpendicular to the direction of the pushing operation while the end portions thereof slide along an inner wall of the aperture portion in the upper region of the housing 301 that is described below. A protrusion portion is provided at a portion of the inner wall of the aperture portion in the upper region of the housing 301. Therefore, before an end portion of the sliding rod 212 of the plunger main body 201 passes a peak portion (below referred to as "the latch point") P of the protrusion portion, the latch part 13 urges the contact C of the contact unit part 15 that is described below in the direction of contacting the fixed terminal 502. In contrast, after the end portion of the sliding rod 212 passes the latch point P, the latch part 13 urges the contact C in the direction of separating from the fixed terminal 502. Therefore, when the machinery or the like is in the electrified state (an ON state), a latch function acts in a direction to maintain electrification, and when the machinery or the like is in the disconnected state (an OFF state), the latch function acts in a direction to maintain disconnection. Consequently, misoperation by an operator of the machinery or the like may be prevented, and occurrences of chattering due to contact bounce and the like may be prevented.

Housing Part

The housing part 14 includes the housing 301 and a waterproofing rubber 302. The housing 301 is a cylindrical housing including respective aperture portions in the upper region and a lower region thereof.

The button 101 is disposed at the upper region of the housing 301 so as to cover the upper region of the housing 301. A groove 303 for disposition of the waterproofing rubber 302 is provided in an outer periphery of the upper region of the housing 301. The waterproofing rubber 302 is disposed in the groove 303 and prevents foreign substances such as water, dust and the like ingressing into the interior of the button 101. Therefore, failures, malfunctions and the like resulting from the ingression of a foreign substance such as water, dust or the like into the interior of the button 101 may be prevented. The twisting coil spring 12 is disposed between the button 101 and the housing 301. The one end of the twisting coil spring 12 is joined to the housing 301, and the other end of the twisting coil spring 12 is joined to the button 101.

The latch part 13 is disposed at the aperture portion in the upper region of the housing 301 so as to close off the aperture portion in the upper region of the housing 301. At this time, the latch point P provided at the inner wall of the housing 301 is disposed at the lower side relative to the two end portions of the sliding rod 212 of the plunger main body 201. Therefore, the latch part 13 urges the contact C of the contact unit part 15 in the direction of contacting the fixed terminal 502. The contact unit part 15 is disposed at the aperture portion in the lower region of the housing 301 so as to close off the aperture portion in the lower region of the housing 301.

Contact Unit Part

As illustrated in FIG. 1B, the contact unit part 15 includes a case 501, the fixed terminal 502, a shifter 503, a contact coil spring 504, and the contact C. The contact unit part 15 is disposed so as to close off the aperture portion in the lower region of the housing 301.

The contact C is in the touching state with the fixed terminal 502 at usual times, and goes into the separated state in conjunction with the pushing operation of the button 101. After the pushing operation, the contact C is restored to the touching state with the fixed terminal 502 in conjunction with a turning and pulling operation of the button 101. That is, when the contact C goes from the touching state with the fixed terminal 502 to the separated state in conjunction with the pushing operation of the button 101, the machinery or the like in the electrified state goes into the disconnected state. Conversely, when the contact C is restored to the touching state with the fixed terminal 502 in conjunction with the turning and pulling operation of the button 101, the machinery or the like in the disconnected state is restored to the electrified state.

Figure 5:
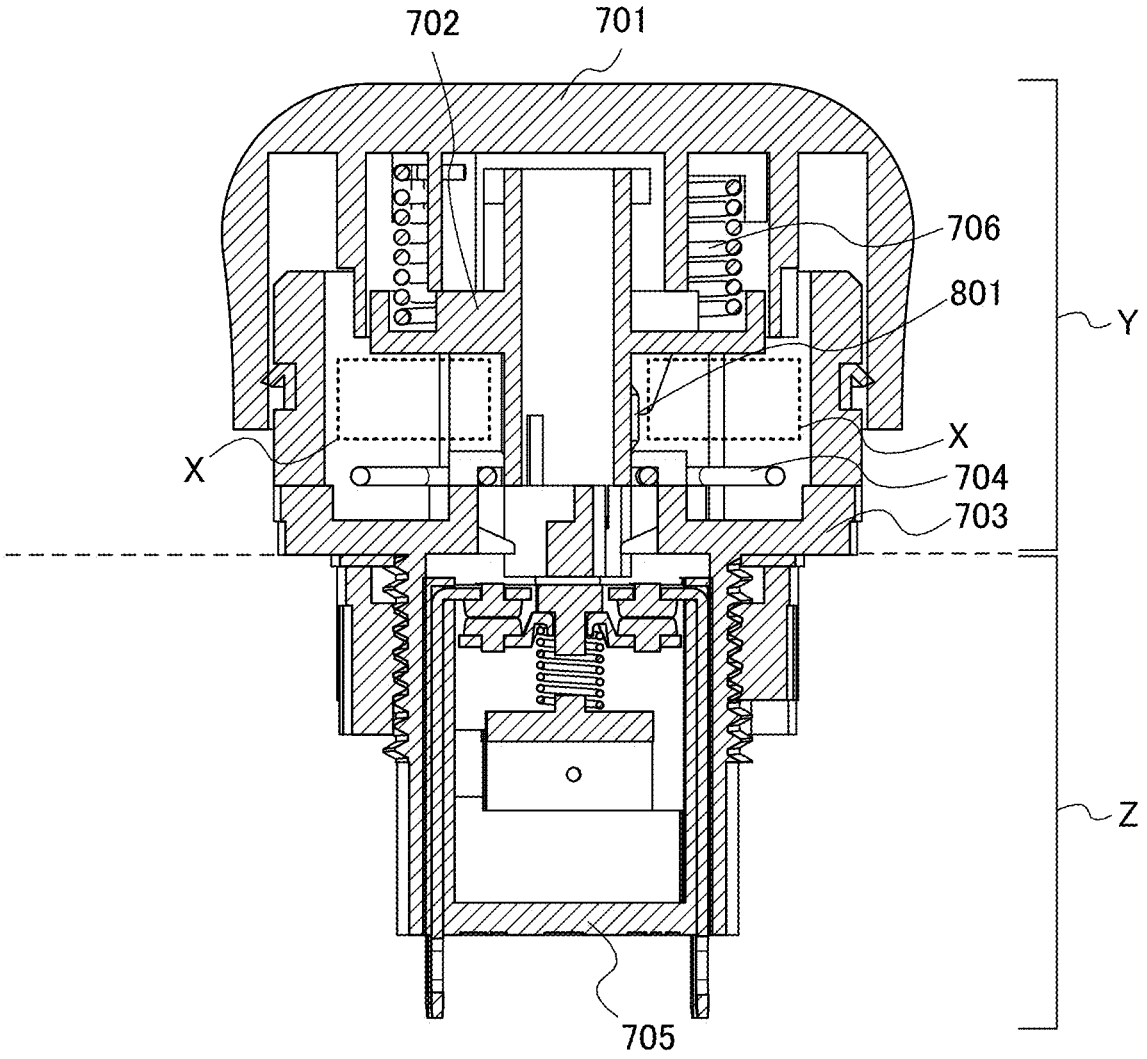
FIG. 5 is a sectional diagram illustrating an example of a conventional emergency stop switch.

As illustrated in FIGS. 2A and 2B and FIGS. 3A and 3B, a region of the contact unit part 15 of the emergency stop switch 1 is disposed in a space Y outside a control box. In contrast, as illustrated in FIG. 5, the whole of a contact unit 705 of a conventional form of emergency stop switch is disposed in a space Z inside a control box. That is, because the latch part 13 of the emergency stop switch 1 is disposed in a space inside the twisting coil spring 12, a space saving is achieved. Consequently, the region of the contact unit part 15 may be disposed in the space Y outside the control box. As a result, a region of the contact unit part 15 that is disposed in the space Z inside the control box may be made smaller. Therefore, space inside the control box may be used efficiently.

Fixed Part

The fixed part 16 is structured with a round nut 401 and a rubber washer 402.

The round nut 401 is a member for fixing the emergency stop switch 1 to the control box. The rubber washer 402 is disposed between the control box and the round nut 401, and prevents the formation of gaps in a joint region between the control box and the emergency stop switch 1. Thus, the emergency stop switch 1 may be fixed so as not to detach from the control box. In addition, the ingression of a foreign substance such as water, dust or the like into the interior of the control box through the joint region between the control box and the emergency stop switch 1 is prevented. Therefore, failures, malfunctions and the like that may be caused by detachment of the emergency stop switch 1 from the control box or the ingression of a foreign substance such as water, dust or the like may be pre-emptively prevented.

—Latch Function—

When an operator of the emergency stop switch 1 performs the pushing operation on the button 101, in conjunction with the pushing operation, the latch part 13 is displaced from an upper region to a lower region of the housing part 14 while being guided by the inner wall of the housing part 14. The plunger main body 201 is provided at the latch part 13, and the latch point P is provided at the inner wall of the housing part 14. Accordingly, the latch function acts before and after the latch part 13 passes the latch point P of the housing part 14.

When the pushing operation is performed on the button 101, as a result, the contact C of the contact unit part 15 separates from the fixed terminal 502. Until the end portions of the sliding rod 212 of the plunger main body 201 pass the latch point P, the latch function acts to urge the contact C and the fixed terminal 502 in the direction of maintaining touching between the contact C and the fixed terminal 502. On the other hand, once the latch part 13 passes the latch point P, the latch function acts to urge the contact C and the fixed terminal 502 in the direction of separating the contact C from the fixed terminal 502. That is, when the machinery or the like is in the electrified state (the ON state), the latch function acts in the direction of maintaining electrification, and when the machinery or the like is in the disconnected state (the OFF state), the latch function acts in the direction of maintaining disconnection. Consequently, misoperation by an operator of the machinery or the like may be prevented, and occurrences of chattering due to contact bounce and the like may be prevented.

Figure 4:
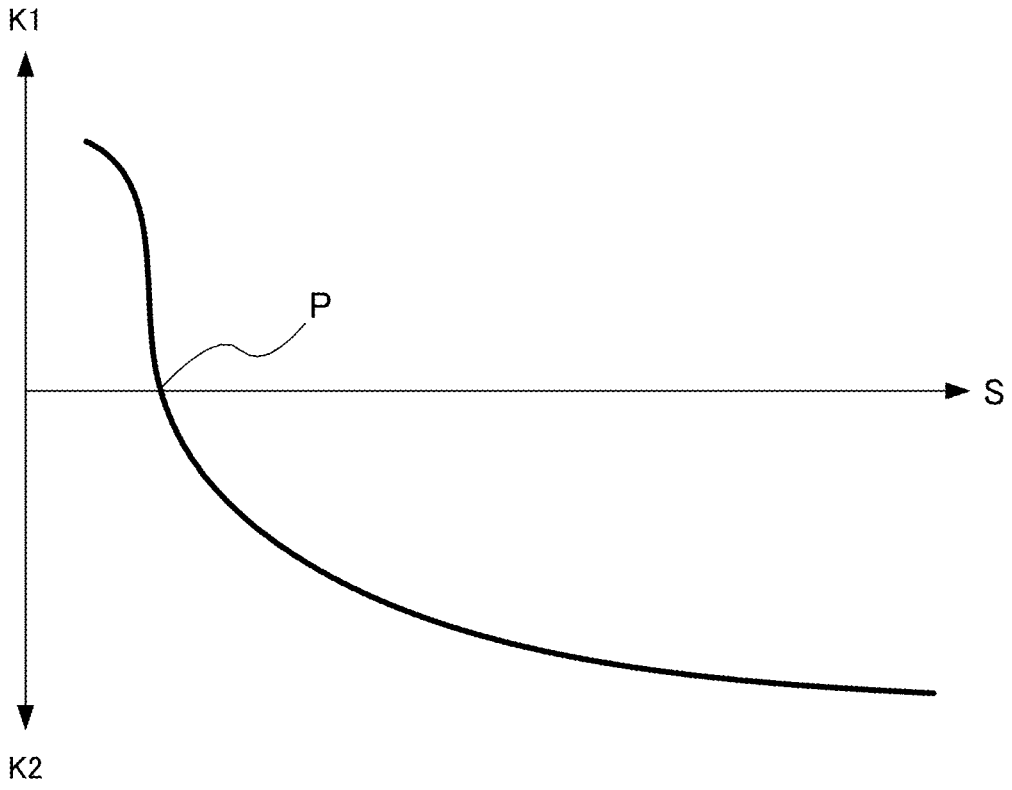
FIG. 4 is a graph depicting magnitudes of force in directions in which a plunger is urged when a pushing operation is performed on the emergency stop switch of FIG. 1A.

The graph in FIG. 4 depicts magnitudes of force in the directions in which the plunger is urged in a single pushing operation. The horizontal axis of the graph in FIG. 4 represents a stroke S of the single pushing operation of the button 101. The vertical axis of the graph in FIG. 4 represents magnitudes of the forces in the directions in which the plunger main body 201 is urged during the single pushing operation. As illustrated by the graph in FIG. 4, at the beginning of the pushing operation of the button 101, the latch function acts to urge the contact C and the fixed terminal 502 in the direction of maintaining touching between the contact C and the fixed terminal 502. Accordingly, a force (K1) acting to preserve the ON state of the machinery or the like is strong. Subsequently, as the pushing operation proceeds, the force (K1) acting to preserve the ON state of the machinery or the like progressively weakens. At the moment that the end portions of the sliding rod 212 of the plunger main body 201 reach the latch point P of the housing 301, the force (K1) acting to preserve the ON state of the machinery or the like is in balance with a force (K2) acting to preserve the OFF state of the machinery or the like. Then, once the end portions of the sliding rod 212 of the plunger main body 201 have passed the latch point P of the housing 301, the force (K2) acting to preserve the OFF state of the machinery or the like progressively strengthens.

Conventional emergency stop switches are also equipped with latch functions. As illustrated in FIG. 5, snap springs 704 are fixed to a portion of a housing 703 of a conventional emergency stop switch, and protrusion portions 801 are provided at a portion of a latch part 702. Consequently, a latch function acts before and after the protrusion portions 801 pass the snap springs 704. More specifically, when the latch part 702 is displaced downward along the inner sides of the snap springs 704 in conjunction with a pushing operation of a button 701, the snap springs 704 touching the protrusion portions 801 are pushed apart to the outer sides thereof. When the latch part 702 is displaced further downward, the protrusion portions 801 cease to touch the snap springs 704. As a result, the snap springs 704 are returned to the original shapes thereof by elastic deformation from the state of being pushed apart to the outer sides.

Thus, in the conventional emergency stop switch, the latch function acts before and after the protrusion portions 801 pass the snap springs 704. However, a stroke for pushing the button 701 is at least 4.5 mm. Therefore, it is necessary to reserve space for this stroke inside the switch. As a result, as illustrated in FIG. 5, there is a large empty space X in the housing 703. Thus, the switch as a whole is larger in size and cannot adapt to advances in size reduction, weight reduction and portability of machinery and the like. Moreover, a region of the contact unit 705 that is disposed in a space inside a control box may not be made smaller. Therefore, the region that is disposed inside the control box is large, as a result of which space inside the control box may not be used efficiently.

—Restoring Function—

When the operator of the emergency stop switch 1 performs the pushing operation on the button 101, the contact C of the contact unit part 15 separates from the fixed terminal 502 as a result. Subsequently, when the operator performs a turning operation on the button 101, the button 101 is restored to the state prior to the pushing operation by elastic deformation of the twisting coil spring 12.

Conventional emergency stop switches are also equipped with restoring functions. As illustrated in FIG. 5, the conventional emergency stop switch is provided with a twisting coil spring 706. When the turning operation has been performed on the button 701, the button 701 is restored to the state prior to the pushing operation by elastic deformation of the twisting coil spring 706. However, a portion of the twisting coil spring 706 of the conventional emergency stop switch illustrated in FIG. 5 that activates the latch function is disposed in an upper region relative to the space X mentioned above. Therefore, the twisting coil spring 706 may not contribute to a size reduction, weight reduction or portability of the switch as a whole. In contrast, because the novel technique of disposing the latch part 13 inside the twisting coil spring 12 as illustrated in FIGS. 2A and 2B and FIGS. 3A and 3B is employed, the space Z at the inner side of the emergency stop switch 1 may be used efficiently. As a result, a region of the contact unit part 15 that is disposed in the space Z inside the control box may be made smaller. Thus, the space Z inside the control box may be used efficiently and a compact switch may be provided.

An embodiment of the present invention is described above but it should be noted that the present invention is not limited to the above embodiment; any modifications and improvements thereto within a scope in which the object of the present invention may be achieved are to be encompassed by the present invention. Further, various modifications may be applied within a scope that does not depart from the gist of the present invention.

For example, the embodiment described above is an emergency stop switch, but application of the present invention is not limited to emergency stop switches; the present invention may be applied to switches for various kinds of buttons.

To summarize the above, a switch in which the present invention is employed may encompass a variety of embodiments provided the following structure is provided. That is, a switch employing the present invention (for example, the emergency stop switch 1 in FIGS. 1A and 1B) is provided with: a cylindrical housing (for example, the housing 301 in FIGS. 1A and 1B); an operating part (for example, the operating part 11 in FIGS. 1A and 1B) disposed at an upper region of the housing and including a button (for example, the button 101 in FIGS. 1A and 1B) that accepts a pushing operation and a turning operation; a contact unit part (for example, the contact unit part 15 in FIGS. 1A and 1B) including a contact (for example, the contact C in FIGS. 1A and 1B) that separates in conjunction with the pushing operation of the button; a twisting coil spring (for example, the twisting coil spring 12 in FIGS. 1A and 1B) disposed inside the button, one end of the twisting coil spring being joined to the housing and another end of the twisting coil spring being joined to the button; and a latch part (for example the latch part 13 in FIGS. 1A and 1B) that includes a plunger (for example, the plunger main body 201 in FIGS. 1A and 1B) and is disposed inside the twisting coil spring and that, when the pushing operation is performed on the button, displaces in a direction of the pushing operation while end portions of the plunger (for example, the sliding rod 212 in FIGS. 1A and 1B) slide along an inner wall of the housing. Thus, a compact switch may be provided that is compatible with advances in size reduction, weight reduction and portability of machinery and the like.

In the switch according to the present invention, the plunger may be compressed in a direction perpendicular to the direction of the pushing operation. Thus, the latch part 13 may be compactly disposed inside the twisting coil spring 12.

In the switch according to the present invention, a shape of a portion of the inner wall of the housing may include a protrusion portion, and when the pushing operation is performed on the button, the protrusion portion may urge the contact in a touching direction before the plunger passes a peak portion of the protrusion portion (for example, the latch point P in FIGS. 2A and 1B and FIGS. 3A and 1B), and may urge the contact in a separating direction after the plunger passes the peak portion of the protrusion portion. Thus, misoperation by an operator of the machinery or the like may be prevented, and occurrences of chattering due to contact bounce and the like may be prevented.

EXPLANATION OF REFERENCE NUMERALS

1 Emergency stop switch
11 Operating part
12 Twisting coil spring
13 Latch part
14 Housing part
15 Contact unit part
16 Fixed part
101 Button
102 Button coil spring
201 Plunger
211 Plunger coil spring
212 Sliding rod
213 Penetrating hole
301 Housing
302 Waterproofing rubber
303 Groove
401 Round nut
402 Rubber washer
501 Case
502 Fixed terminal
503 Shifter
504 Contact coil spring
701 Button
702 Latch part
703 Housing
704 Snap spring
705 Contact unit
706 Twisting coil spring
801 Protrusion portion
C Contact
P Latch point S Stroke
X Space
Y Space
Z Space

The invention claimed is:

1. A switch comprising: a cylindrical housing;

an operating part disposed at an upper region of the housing and including a button that accepts a pushing operation and a turning operation;

a contact unit part including a contact that separates in conjunction with the pushing operation of the button;

a twisting coil spring disposed inside the button, one end of the twisting coil spring being joined to the housing and another end of the twisting coil spring being joined to the button; and a latch part that includes a plunger and is disposed inside the twisting coil spring and that, when the pushing operation is performed on the button, displaces in a direction of the pushing operation while causing a portion of the plunger to slide along an inner wall of the housing and compressing the portion of the plunger in a direction perpendicular to the direction of the pushing operation, wherein the portion of the plunger is an end portion of a sliding rod which is compressed by an elastic force of a coil spring in the direction perpendicular to the direction of the pushing operation, and the portion of the plunger is disposed inside the twisting coil spring.

2. The switch according to claim 1, wherein a shape of a portion of the inner wall of the housing includes a protrusion portion and, when the pushing operation is performed on the button, the latch part urges the contact in a touching direction before the portion of the plunger passes a peak portion of the protrusion portion, and urges the contact in a separating direction after the portion of the plunger passes the peak portion of the protrusion portion.

3. A switch comprising:

a cylindrical housing;

an operating part disposed at an upper region of the housing and including a button that accepts a pushing operation and a turning operation;

a contact unit part including a contact that separates in conjunction with the pushing operation of the button;

a twisting coil spring disposed inside the button, one end of the twisting coil spring being joined to the housing and another end of the twisting coil spring being joined to the button; and a latch part that includes a plunger and is disposed inside the twisting coil spring and that, when the pushing operation is performed on the button, displaces in a direction of the pushing operation while causing a portion of the plunger to slide along an inner wall of the housing and expanding and contracting a plunger coil spring which moves the portion of the plunger in a direction perpendicular to the direction of the pushing operation, wherein the portion of the plunger is disposed inside the twisting coil spring.

* * * * *